US009208977B2

(12) United States Patent
Lang et al.

(10) Patent No.: US 9,208,977 B2
(45) Date of Patent: Dec. 8, 2015

(54) SWITCH HAVING A QUENCHING CHAMBER

(75) Inventors: Volker Lang, Bonn (DE); Lutz Friedrichsen, Cologne (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 78 days.

(21) Appl. No.: 13/991,940

(22) PCT Filed: Dec. 7, 2011

(86) PCT No.: PCT/EP2011/072097

§ 371 (c)(1),
(2), (4) Date: Jun. 25, 2013

(87) PCT Pub. No.: WO2012/076606

PCT Pub. Date: Jun. 14, 2012

(65) Prior Publication Data

US 2013/0264310 A1 Oct. 10, 2013

(30) Foreign Application Priority Data

Dec. 7, 2010 (EP) ..... 10194012

(51) Int. Cl.

| | |
|---|---|
| ***H01H 33/18*** | (2006.01) |
| ***H01H 1/20*** | (2006.01) |
| ***H01H 9/34*** | (2006.01) |
| ***H01H 9/44*** | (2006.01) |
| *H01H 33/59* | (2006.01) |

(52) U.S. Cl.

CPC ..... *H01H 33/182* (2013.01); *H01H 1/20* (2013.01); *H01H 9/346* (2013.01); *H01H 9/443* (2013.01); *H01H 33/596* (2013.01)

(58) Field of Classification Search

CPC ..... H01H 9/30; H01H 9/34; H01H 9/36; H01H 9/50; H01H 9/54; H01H 9/443; H01H 33/04; H01H 33/18; H01H 33/20; H01H 33/00; H01H 71/16; H01H 17/2463; H01H 33/596

USPC ..... 218/2, 34, 25, 31, 47, 39, 40, 69, 115, 218/152, 156; 335/153, 163, 177

See application file for complete search history.

(56) References Cited

U.S. PATENT DOCUMENTS

| | | | | |
|---|---|---|---|---|
| 2,332,446 | A | 10/1943 | Konrad | |
| 2,575,060 | A | 11/1951 | Matthias | |
| 5,763,847 | A * | 6/1998 | Moldovan et al. | 218/38 |
| 7,915,985 | B2 | 3/2011 | Schmitz et al. | |
| 8,502,102 | B2 * | 8/2013 | Eriksson et al. | 218/150 |

FOREIGN PATENT DOCUMENTS

| | | |
|---|---|---|
| EP | 0473014 B2 | 3/1992 |
| EP | 2061053 A2 | 5/2009 |

* cited by examiner

*Primary Examiner* — Renee S Luebke
*Assistant Examiner* — William Bolton
(74) *Attorney, Agent, or Firm* — Leydig, Voit & Mayer, Ltd.

(57) ABSTRACT

A switch for polarity-independent multi-pole direct current operation includes at least two switching chambers. Each switching chamber includes a single circuit breaker with a stationary contact having a first contact region and a movable electrically conductive contact part having a second contact region. The stationary contact and movable contact part are configured to create a connection between the first and the second contact regions in the ON state and to disconnect the first and the second contact regions in the OFF state. Each chamber also includes two arc chutes for quenching an arc forming between the first and the second contact regions when switching to the OFF state. At least two magnets are configured to generate a magnetic field so as to exert a magnetic force on the arcs to divert each arc in a direction of an arc chute independent of the direction of current.

15 Claims, 3 Drawing Sheets

SWITCH HAVING A QUENCHING CHAMBER

CROSS REFERENCE TO RELATED APPLICATIONS

This application is a U.S. National Phase application under 35 U.S.C. §371 of International Application No. PCT/EP2011/072097, filed on Dec. 7, 2011, and claims benefit to European Patent Application No. EP 10194012.0, filed on Dec. 7, 2010. The International Application was published in German on Jun. 14, 2012, as WO 2012/076606 A1 under PCT Article 21 (2).

FIELD

The invention relates to a switch with arc chutes for fast quenching of the arc in the disconnection process.

BACKGROUND

Electrical switches are components of an electrical circuit having internal electrically conductive contacts to create electrically conductive connections (switching state "ON" or ON state) or disconnect these connections (switching state "OFF" or OFF state). In case of a current-carrying connection which needs to be separated, electrical current flows through the contacts until they are disconnected. When an inductive circuit is disconnected by using a switch, the current flowing through the contacts cannot decrease to zero immediately. In this case there is an arc formed between the contacts. The arc is a gas discharge in a non-conductive medium, for example air. In switches in alternating current operation (AC), the arc is quenched regularly at the zero-crossing point of the alternating current. Due to not having a zero-crossing point in switches in direct current operation (DC) when disconnecting the contacts (switching off) there are arcs formed which burn steadily provided that the arc voltage is significantly lower than the operating voltage. When the circuit is operated having sufficient current and voltage (typically at over 1 A and over 50V), the arc will not extinguish by itself. For this purpose, these switches are fitted with arc chutes for quenching the arc. The arcing time (the duration of the arc burning) should be kept as short as possible, because the arc generates a significant amount of heat, and it causes burning off the contacts and/or causes thermal load on the contact bridge in the switch and thus it causes a reduction of the service life of the switch. In case of two pole or multi-pole switches with two or more switching chambers, the arcs generate a corresponding higher amount of heat than in case of one pole switches. In this case it is especially important that the arc is quenched quickly.

Quenching the arc is accelerated generally by using a magnetic field with the polarity set up in a way to generate a driving force on the arc in the direction of the arc chutes. The size of the driving force depends on the strength of the magnet(s). Permanent magnets are generally used to create a strong magnetic field. Unfortunately the driving force of a magnetic field in the direction of the arc chutes is created only in case of a specific direction of current. In order to avoid the faulty installation of the switches due to incorrect polarity or in case of switches required for both directions of current, the switch should be able to quench the arc, which is created between the open contacts, quickly irrespective of the actual polarity. It would be especially desirable to have two pole switches with a structure not considerably more complex than one pole switches.

SUMMARY

In an embodiment, the present invention provides a switch for polarity-independent multi-pole direct current operation including at least two switching chambers. Each switching chamber includes a single circuit breaker with a stationary contact having a first contact region and a movable electrically conductive contact part having a second contact region. The stationary contact and movable contact part are configured to create an electrically conductive connection between the first and the second contact regions in the ON state of the switch and to disconnect the first and the second contact regions in the OFF state of the switch. Each switching chamber also includes two arc chutes configured to quench an arc forming between the first and the second contact regions when switching to the OFF state. At least two magnets are configured to generate a magnetic field at least in the area of the first and the second contact region of the switching chambers so as to exert a magnetic force on the arcs to divert each arc in a direction of one of the respective arc chutes independent of the direction of current. The movable contact parts of the switching chambers are substantially aligned in parallel with the magnetic field generated in the switching chambers.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
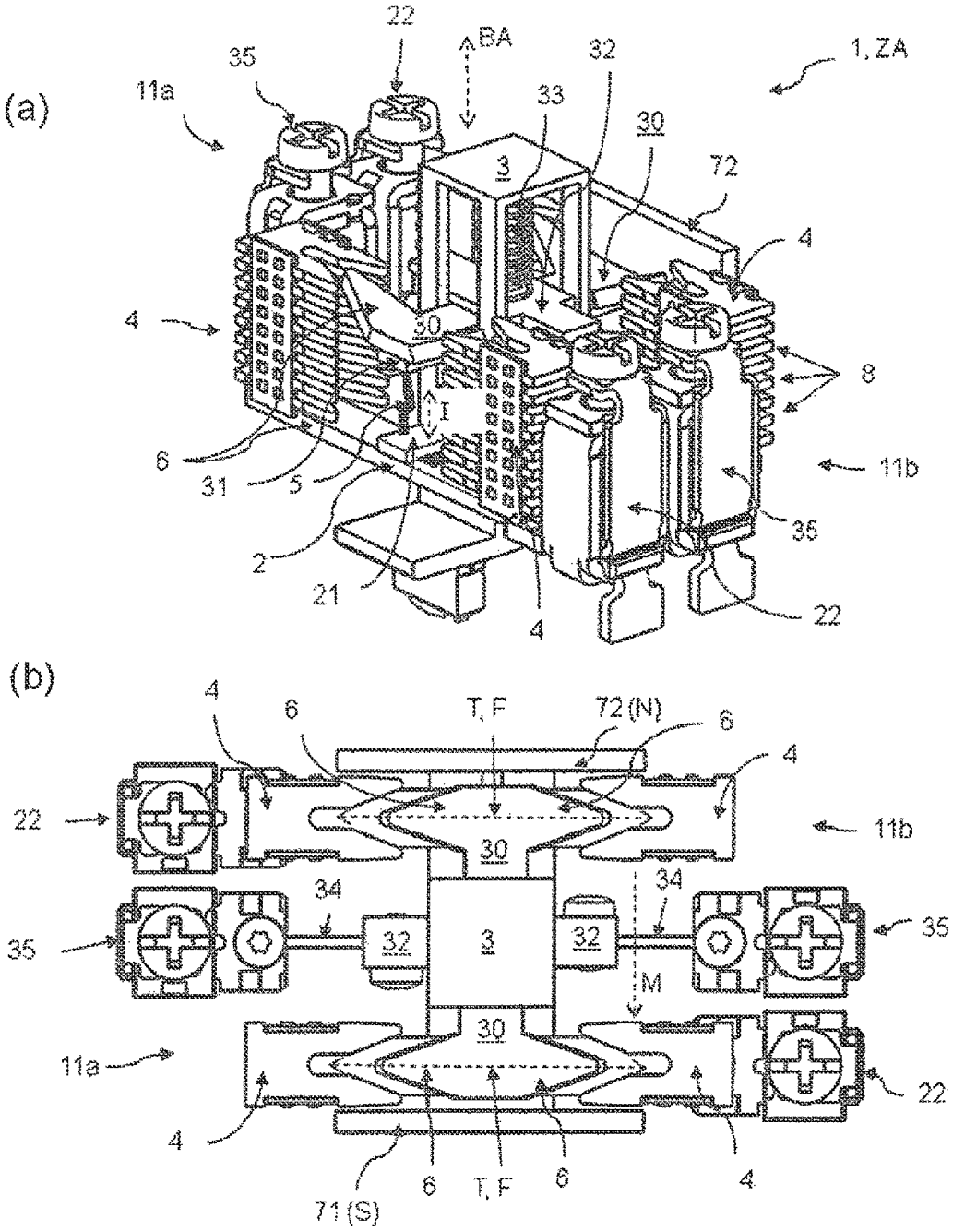
FIG. 1 shows (a) a perspective view and (b) a top view of an embodiment of a switch in the OFF state with two switching chambers aligned in one plane.

An aspect of the present invention is to provide a switch capable of multi-pole operation, which can quench the arcs created quickly and reliably, independent of the direction of current.

This function is implemented by using a switch capable of polarity-independent multi-pole direct current operation with at least two switching chambers, where each switching chamber consists of a single circuit breaker with an stationary contact with a first contact region and a movable electrically conductive contact with a second contact region to create an electrically conductive connection between the first and the second contact region in the ON state of the switch and to disconnect the first and the second contact region in the OFF state of the switch and two arc chutes for quenching the arc which can form between the first and the second contact region when switching to the OFF state; and also minimum two magnets to generate the electrical field at least in the area of the first and the second contact region of the switching chamber to create a magnetic force on the arcs to divert each arc in the direction of one or the other arc chute irrespective of the direction of current, whereas the movable contacts of the switching chamber are essentially aligned in parallel with the magnetic field generated in the switching chambers. The switch has a quick, reliable quenching operation independent of the direction of current and therefore prevents faulty installation due to incorrect polarity and it can be used for applications where a switch is required for both directions of current. By quenching the arc quickly, the thermal load on the contact bridge is also minimised. Because of the components of the switch presented in the invention, the switch can have a symmetrical structure, and it is therefore more cost-efficient. When disconnecting and closing the contacts, the single circuit breaker performs a translational movement. The term "essentially" includes in case of the present invention all implementations which deviate by less than 10% from the nominal value or the mean value.

The switch covers all types of switches suitable for multi-pole operation. These switches can be for example two pole or multi-pole switches. The number of switching chambers include two or more switching chambers, where the switching chambers are operated preferably aligned in parallel to each other. Examples of these switches are contactors, load disconnecting switches or power switches. The switch is suitable for direct current operation, however, the switch could be used for alternating current operation. Alternative embodiments of the present invention can include switches in case of which the two or more switching chambers are connected in series and therefore they are actually operated as a one pole switch. These switches are, however, suitable for multi-pole operation, because they only require changing the circuitry of the switching chambers for multi-pole operation. In case of polarity-independent direct current operation, the switch is operated in a direct current circuit, and in this case the quick quenching of the arc in the switch does not depend on the direction of current in the switch and therefore it does not depend on the direction of current of the arc. In this case the arcs can be formed between the first and the second contact region of the switching chambers, in case of which the current flows from the first to the second contact region or backwards. The essentially constant magnetic field with a fixed direction (determined by fitting the magnets in the switch) forces the arc in case of a fixed direction of current always in the direction defined by the Lorentz force and therefore in case of operating the switch in the opposite direction of current (=different direction of current in the arc) there should be other measures implemented for the quick quenching of the arc, that is, a second arc chute is installed for each switching chamber for the other possible direction of forces due to the two possible directions of current in the arc. The requested arrangement offers the advantage that the switch will have a simple, symmetrical and therefore cost-efficient structure.

In this context a single circuit breaker refers to the mechanical components, which provide a simple interruption of an electric circuit. For this reason, single circuit breakers are fitted as compared to double circuit breakers only with a first and a second contact region where the current in the OFF state is ruptured by isolating the contact regions. The isolating distance (the distance between the first and the second contact region in the OFF state) of a single circuit breaker should be designed as double the isolating distance of the corresponding double circuit breaker. In each single circuit breaker, the first and the second contact region refer to the surfaces of the stationary contacts and of the movable contacts, which are in direct contact after closing the switch (ON state). In the ON state, the current flows from the stationary contact through the first contact region into the second contact region of the contact, with which it is connected. The stationary contact and also the first and the second contact region and the movable contact part are therefore made of electrically conductive material. For closing the contacts (ON state) the contact with the second contact region moves unto the first contact region. The first and the second contact region can be sub regions of the stationary contact or of the contact part or separate components, which are located on the stationary contact or on the contact part. The above movement is performed along a movement axis of the contact part, perpendicular to the surface areas of the contact regions. The contact part is for example a contact bridge made of a non-conductive material, primarily plastic, held in a movable position with a spring, which exerts the necessary contact pressure in the ON state of the switch. The switch is opened by moving the contact part in the opposite direction. The movement axis of the contact part is aligned essentially perpendicular to the direction of movement of the arc in the arc chutes. The contact part can be moved manually or electrically. The first and the second contact region can have a different form and be made of different materials. The surfaces of the first and the second contact region can vary between wide surfaces and point-shaped contacts. The contact regions can be made of any electrically conductive material, for example silver tin oxide.

The stronger the magnetic field at the location of the arc, the faster the arc is forced into the arc chute along the bridge plate; and in this process the arc is quenched. The magnetic field exerting a driving force on the arc is essentially a homogeneous magnetic field present preferably at least in the area of the first and the second contact region. The term "essentially" includes in case of the present invention all implementations which deviate by less than 10% from the nominal value or the mean value. The stronger the magnetic field at the location of the arc, the stronger the effect of the driving Lorentz force is on the arc. In an embodiment of the invention a permanent magnet is therefore used. A very strong permanent magnetic field can be generated by using a permanent magnet, for example by using a rare-earth magnet. Rare-earth magnets are made for example of an NdFeB or SmCo alloy. These materials generate a very strong coercive field and therefore the magnets used can have the form of very thin plates for example, and as a consequence the switch can have a very compact structure.

In an embodiment of the invention the magnets are aligned in a manner that the magnets extend at least along the arc deflector plates. In a preferred embodiment, the magnets extend even over the arc chutes. The time required for driving the arcs into the arc chutes and along the bridge plates depends on the strength of the magnetic field and on the homogeneity of the magnetic field. Therefore the magnets are preferably aligned in a manner that they create a magnetic field perpendicular to the current flow of the arc and perpendicular to the desired direction of movement of the arc. The specialist can select the appropriate form of the magnet part of this invention. The magnets are aligned preferably as pairs of 2 magnets, therefore two magnets or multiples thereof are preferably used in a switch. In a different embodiment at least two plate-shaped magnets are used, preferably permanent magnets, and their surfaces are aligned parallel to each other. The surfaces of the magnets are aligned preferably parallel to the direction of movement of the arcs. In order to quench the arcs quickly in case of both directions of the current flow, it is beneficial if a strong magnetic field can drive the arcs in the area of movement of the arcs for both directions of the current flow. When the magnets are aligned accordingly, they can generate a homogeneous magnetic field leading to the arc chutes.

In an embodiment of the invention, at least in one of the switching chambers the arc deflector plates extend in two opposite directions from the first contact region and the second contact region to two arc chutes located at the two ends of the arc deflector plates. The term "extend" comprises the possible implementations that the arc deflector plates project to the respective contact regions and/or arc chutes, without being fixed permanently to them, or the arc deflector plates can have a fixed connection at least with the first contact region and/or arc chutes. The arc deflector plates are preferably fixed to the first contact region though. Therefore there are no obstructions for the movement of the arc like for example an air gap, at least in case of the stationary contact. The arc deflector plate extends at the contact part at least near the second contact region to facilitate a quick diverting of the arc from the second contact region. Alternatively the arc deflector plate for the second contact region can be connected to the contact part, and at the other end of the arc deflector plate it can extend near the arc chute. The arc chute comprises of all types of components, which are suitable for quenching an arc. In an embodiment the arc chute comprises a variety of arc deion plates between the first arc deflector plates which are both aligned in parallel to each other in the arc chute. In order to quench the arc quickly, the magnets exert a Lorentz force on the arc preferably for the period until the arc enters the arc chute. If there is sufficient overall space inside the switch, it is therefore beneficial to align the permanent magnets as close as possible to the arc chutes or even laterally over and above the arc chutes. The deion plates in the arc chutes are V-shaped for example. In the arc chute the arc is split up into a multitude of partial arcs (deion chamber). The minimum voltage required for maintaining the arc is proportional to the number of deion plates installed in the arc chute, and therefore the voltage required for maintaining the arc exceeds the available voltage, and therefore the arc is quenched. The required number of deion plates in an arc chute in a single circuit breaker, where the arc is always quenched by using 1 arc chute (always using only one or the other arc chute), is always higher accordingly compared to arc chutes of double circuit breakers with the same operating voltage. The deion plates are mounted in an insulating material; and the arc deflector plates are also mounted in the same insulating material. The arc deflector plates can be of any form which is appropriate for deflecting the arc in the first arc chute. The arc deflector plates can be made of die-cut parts as well. The thickness and width of the arc deflector plates can also vary. The distance between the lower and the upper arc deflector plate can increase with the increasing distance to the first and the second contacts.

In an embodiment of the invention the contact parts of adjacent switching chambers are mounted on a common contact bridge to create their coupled movement. The contact bridge is designed to ensure that the contact parts of both single circuit breakers of adjacent switching chambers are moved simultaneously, thus both contact parts are moved either into the ON state or into the OFF state of the switch. The two contact parts are not moved independent of each other. Through their joint movement, they are switched on and off at the same time, and the complexity of the switch is lower to ensure a more cost-efficient manufacturing process. In a different embodiment, the contact bridge is designed to ensure that the contact parts of adjacent switching chambers are isolated from each other. In this manner there can be no short-circuit between adjacent contact parts; and this setup facilitates the reliable operation of the switch especially in case of using a common contact bridge. In a preferred embodiment, the contact bridge consists of a mounting component made of an electrically insulating material, and the contact parts of adjacent switching chambers are mounted on this component. This insulating material can be plastic for example. If the contact parts are mounted on a common mounting component, the contact parts are isolated from each other simply by selecting the appropriate material of the mounting component. Moreover, the common mounting of contact parts on this mounting component facilitates the simple mechanical movement of the contact parts with the movement of the common mounting component.

In an embodiment, the contact bridge including the switching chambers adjacent to the contact parts and the mounting component make up a single mechanical unit. The mechanical unit performs a translational movement. As compared to state of the art switches, the movement for disconnecting the contact does not include any rotational component, and therefore the switch presented in this invention does not require any mechanical transmission. Therefore the manufacturing process of the switch becomes more simple and more cost-efficient.

In an embodiment the contact part of the switching chamber is connected to a terminal clamp with a stranded wire. In this manner the contact part is connected despite having a movable mounting component and attaching the contact part to this mounting component. The movable stranded wire is made of flexible copper for example. The stranded wire is preferably fastened to the mounting component of the contact bridge and fitted with an electrically conductive connection to the contact part.

In an embodiment of the switch presented in this invention at least two switching chambers are aligned in one plane; and all switching chambers are aligned preferably in one plane. This offers the advantage that the switch has a more simple symmetrical structure and low installation height and therefore the manufacturing process becomes more cost-efficient. In a preferred embodiment, thus the contact parts, the arc deflector plates and the arc chutes of adjacent switching chambers are aligned in one plane. In this manner the switching chambers can be integrated in a very compact structure in the switch. In a further embodiment, the magnets are installed laterally outside the switching chambers aligned in a manner to generate essentially a homogeneous magnetic field at least in the area of the first and the second contact region of all switching chambers aligned in one plane. With this alignment of the magnets, the number of magnets used is minimised on the one hand, and this reduces the complexity of the switch, leading to a more cost-efficient manufacturing. On the other hand, a more compact switch can be manufactured due to the reduced number of components (only 2 magnets). Because the magnets preferably generate a homogeneous magnetic field across two or more switching chambers, permanent magnets are preferably used in this setup, made of a material with high coercive field strength.

In an alternative embodiment of the switch presented in this invention, there are at least two switching chambers aligned on top of each other. With this setup the switch can have different dimensions, and it can be used for corresponding applications as compared to aligning the switching chambers in one plane. The alignment of the switching chambers on top of each other can be combined in different embodiments with the alignment of the switching chambers in one plane. Two switching chambers can be aligned for example in one plane and two other switching chambers in a different plane and aligned above the first two switching chambers. In this setup there are two pairs of adjacent switching chambers in one plane and two pairs of switching chambers aligned on top of each other. This switch would be thus adequate for a four pole switching operation. The number of switches in the above example can be extended or modified by the specialist within the framework of this invention by aligning 3, 4, 5 or more switching chambers in one plane or 3, 4, 5 or more switching chambers on top of each other or arbitrary combinations of switching chambers side by side and on top of each other. By the possible symmetrical alignment of switching chambers, a switch consisting of 4 switching chambers can be made for example, and this switch becomes very compact and therefore space saving.

In an embodiment the axes of movement of the contact parts coincide in case of aligning the switching chambers on top of each other. The switch can be made even more compact in this manner.

In a further embodiment, the magnets are installed laterally outside the switching chambers aligned in a manner to generate an essentially homogeneous magnetic field at least in the area of the first and the second contact region of all switching chambers aligned on top of each other. The switch can be made even more compact in this manner, ensuring at the same time similarly good arc driving behaviour.

FIG. 1(*a*) shows a perspective view of an embodiment of a switch 1 in the OFF state ZA with two switching chambers 11*a* and 11*b* for two pole operation aligned in one plane. Both switching chambers 11*a* and 11*b* consist of a single circuit breaker with a stationary contact 2 with a first contact region 21 and a movable electrically conductive contact part 30 with a second contact region 31. The movable contact part 30 is used for establishing an electrically conductive connection between the first and the second contact region 21 and 31 in the ON state of switch 1 and for disconnecting the first and the second contact region 21 and 31 in the OFF state of switch 1. The contact parts 30 of the adjacent switching chambers 11*a* and 11*b* are grouped together here with a common contact bridge 3 to ensure their coupled movement along the direction of movement BA. The contact parts are mounted using the mounting component 32 part of contact bridge 3, which is made of an electrically insulating material (for example plastic) mounted on the contact bridge 30 to ensure their electrical isolation from each other. The contact parts 30 are connected using a movable stranded wire 34 to the terminal clamps 35 for the contact parts 30 of the switching chambers 11*a* and 11*b*. The contact parts 31 of both switching chambers are mounted on the mounting component 32; and at the same time they are electrically isolated from each other by the mounting component 32 made of plastic. The mounting component 32 and the two contact parts 30 of the adjacent switching chambers 11*a* and 11*b* make up a solid mechanical unit. Each switching chamber 11*a* and 11*b* consists of two arc chutes 4 with deion plates 8 for quenching the arc 5, which can form between the first and the second contact region 21 and 31 when the switch moves to the OFF state. In this embodiment, in order to create a magnetic field to generate a possibly strong magnetic force F on the arc 5, the magnet 72 extends from the first and the second contact region 21 and 31 of the switching chambers 11*a* and 11*b* laterally over the arc chute 4 up to the end of the arc chute. To provide a clear overview, magnet 71 is shown only on FIG. 1(*b*). In this embodiment, magnet 72 generates the magnetic north pole and magnet 71 generates the magnetic south pole of the magnetic field in the switching chamber. The direction of the magnetic field is shown with the dashed arrow M in FIG. 1(*b*). According to a direction of current I of the arc (shown in FIG. 1(*a*) with a dashed arrow between contact regions 21 and 31) from the second to the first contact region and in the opposite direction respectively, the forces F are exerted on the arc 5 burning between the first and the second contact region 21 and 31 of the two switching chambers 11*a* and 11*b*, and the forces drive the arc in the respective arc chutes 4. Furthermore, the arc deflector plates 6 extend in two opposite directions from the first contact region 21 and the second contact region 31 to the two arc chutes 4 located at the terminations of the arc deflector plates 6. A corresponding (upper) arc deflector plate stretches from the contact part 31 similarly to the arc chute 4. In this setup the upper arc deflector plate is grouped with the movable contact part 30 and it extends as close as possible to the arc chutes 4. In an alternative embodiment the upper arc deflector plates can be fastened to the arc chute and in this manner they can extend as close as possible to the contact part. In this manner the arc 5 is driven particularly fast by the constantly present force F in the arc chute 4. By using two arc chutes 4 for each of the switching chambers 11*a* and 11*b*, each arc 5 is driven in the direction of one of the arc chutes 4 irrespective of the direction of current in the arc 5, and the movable contact parts 30 of the switching chambers 11*a* and 11*b* are aligned essentially perpendicular to the direction of movement T of the arc 5 to ensure a compact alignment of several switching chambers in one plane as much as possible, see FIG. 1(*b*). Analogous to the terminal clamps 35 of the contact parts 30, the switching chambers 11*a* and 11*b* are fitted with the corresponding terminal clamps 22 for the stationary contacts 2.

Figure 2:
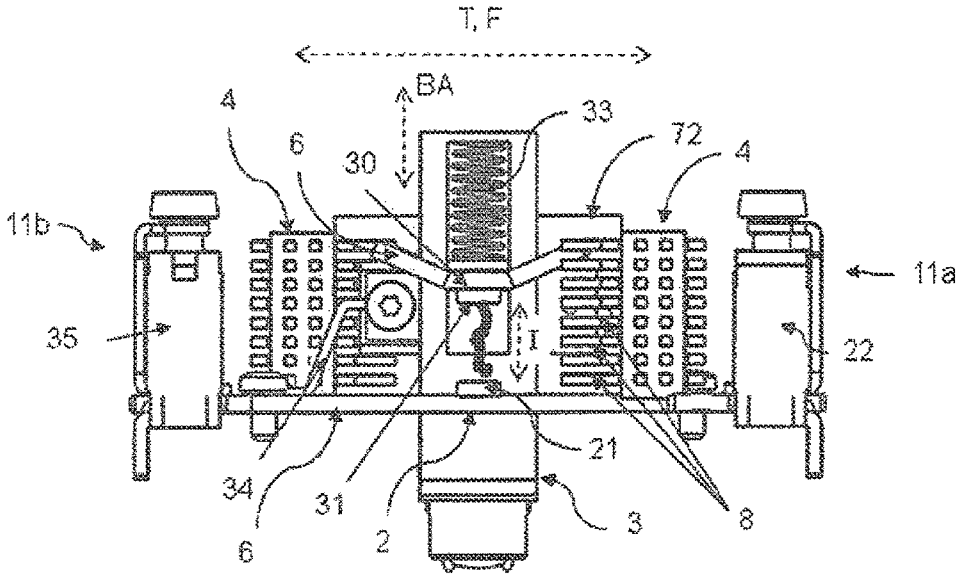
FIG. 2 shows a side view of switch 1 in the OFF state ZA according to FIG. 1.

FIG. 2 shows the side view of switch 1 in the OFF state according to FIG. 1. To provide a clear overview, part of the components of the two switching chambers 11*a* and 11*b* are not presented as compared to FIG. 1. The contact bridge 3 includes a mounting component 32 which is installed in a movable position along the direction of movement BA in a guide of the contact bridge 3 by using a spring 33. The mounting component ensures the common mounting of switching chambers 11*a* and 11*b*, which are adjacent to contact parts 30; and they are aligned in the same plane. The second switching chamber 11*b* is shown in FIG. 2 as the rear switching chamber. On its side facing the first contact region 21, the contact part 30 has a second contact region 31. The first and the second contact region 21 and 31 are shown here as block-shaped components; and they are installed on the stationary contact 2 and on the contact part 30 respectively. The spring 33 in the contact bridge 3 presses together the first and the second contact region 21 and 31 in the ON state with the required contact pressure to establish the electrical contact. The contact regions 21 and 31 can be connected with the corresponding terminal clamps 22 and 35 to an electrical circuit. For this purpose the arc deflector plate 6 of the stationary contact is connected to terminal clamp 22. The terminal clamps 35 are connected to the contact part 30 with a movable stranded wire 34. In this manner voltage can be applied to the movable contact part 30 irrespective of the position of the contact part 30. The movable stranded wire 34 is made of flexible copper. The stranded wire 34 is fastened to the mounting component 32 of the contact bridge 3 and it is electrically connected to contact part 30.

Figure 3:
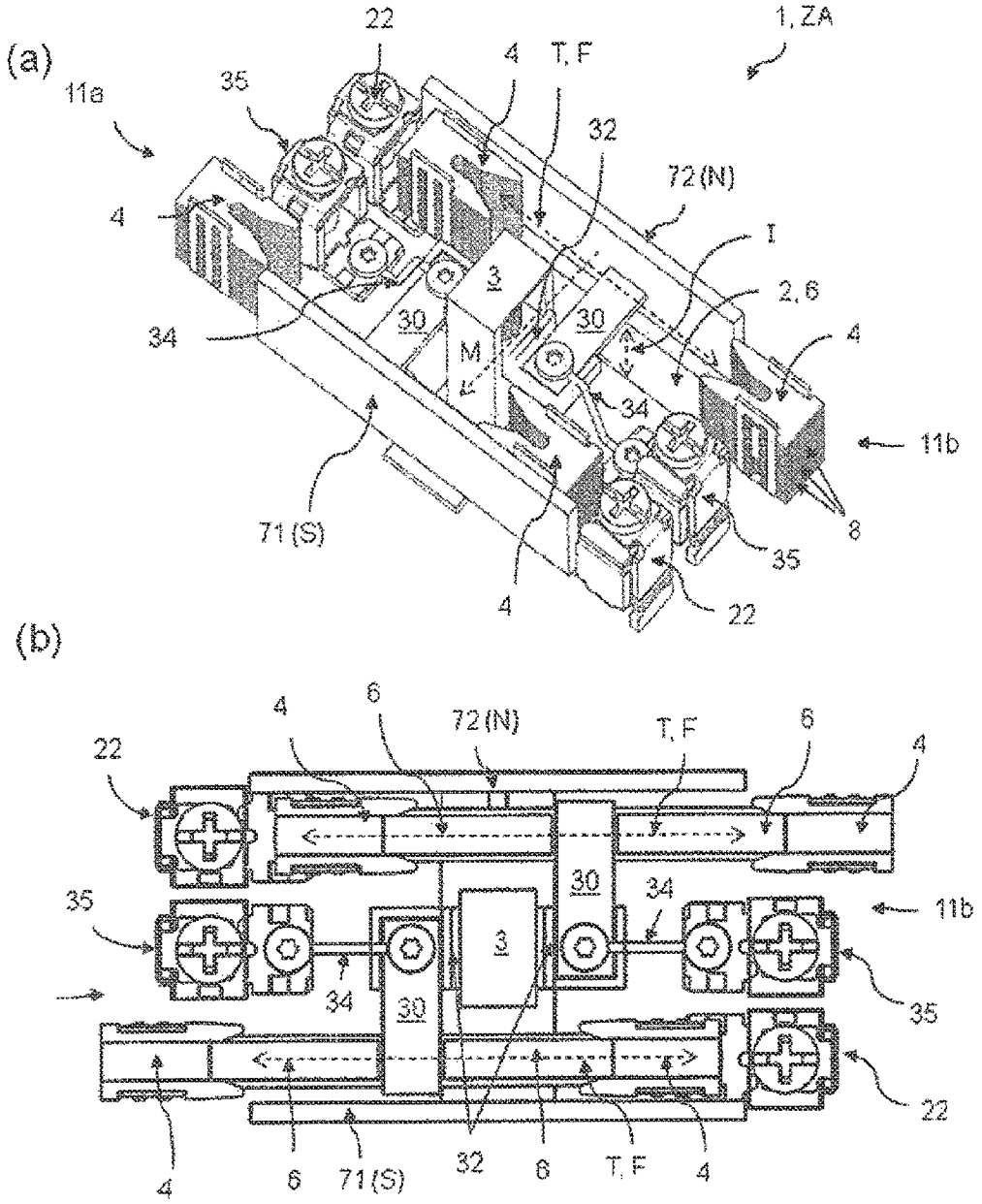
FIG. 3 shows a different embodiment of a switch in (a) a perspective view and (b) a top view.

FIG. 3 shows a different embodiment of the switch 1 in the OFF state ZA in (a) perspective view and (b) top view. The same components are included in this embodiment too as presented in FIGS. 1 and 2. In this embodiment, however, the movable contact parts 30 are not aligned along a line as presented in FIG. 1, but they are installed in an offset position parallel to each other. Correspondingly, the mounting component 32 stretches essentially vertically to the contact parts 30. The contact parts 30 are electrically connected to the terminal clamps 35 with the stranded wire 34. By aligning the contact parts 30 in an offset position in the common contact bridge 3 forming a single mechanical unit, the switch 1 can be manufactured in a more compact form.

The detailed presentation of the invention in this section and the figures should be interpreted as examples of the possible embodiments in the framework of this invention and therefore they should not be interpreted restrictively. Especially the sizes specified must be adapted by the specialist depending on the operating conditions of the switch (amperage, voltage). Therefore all sizes specified are to be interpreted as examples of specific embodiments.

Alternative embodiments which are possibly considered by the specialist in the framework of the present invention are also included in the scope of protection of the present invention. In the claims, the expressions "one/a" also include the plural form. The reference numerals used in the claims are not to be interpreted restrictively.

REFERENCE SYMBOL LIST

1 Switch according to the present invention
11*a* and 11*b* Switching chambers in switch 1
2 Stationary contact
21 First contact region
22 Connection clamp of the stationary contact
3 Contact bridge
30 Movable contact part
31 Second contact region
32 Mounting component
33 Spring of the contact bridge
34 Stranded wire
35 Connection clamp of the contact bridge
4 Arc chute
5 Arcs
6 Arc deflector plate
71, 72 Magnets, preferably permanent magnets
BA Axis of movement of the movable contact part
I Direction of current of the arc
M Magnetic field
T Direction of movement of the arc
F Lorentz force exerted on the arc
ZA Disconnected switch (OFF state)

The invention claimed is:

1. A switch for polarity-independent multi-pole direct current operation, the switch comprising:

at least two switching chambers, each switching chamber including:

a single circuit breaker with a stationary contact having a first contact region and a movable electrically conductive contact part having a second contact region, the stationary contact and movable electrically conductive contact part being configured to create an electrically conductive connection between the first and the second contact regions in the ON state of the switch and to disconnect the first and the second contact regions in the OFF state of the switch, a first arc chute configured to quench an arc forming between the first and the second contact regions when switching to the OFF state from the ON state with current flow in a first direction, and a second arc chute configured to quench an arc forming between the first and the second contact regions when switching to the OFF state from the ON state with current flow in a second direction opposite the first direction; and at least two magnets configured to generate a magnetic field at least in the area of the first and the second contact region of the switching chambers so as to exert a magnetic three to divert an arc having current flow in the first direction into the first arc chute and so as to exert a magnetic force to divert an arc having current flow in the second direction into the second arc chute, wherein the movable contact parts of the switching chambers provide, upon creation of the electrically conductive connection between the first and the second contact regions in the ON state of the switch, a current path that is substantially aligned in parallel with the magnetic field generated in the switching chambers by the at least two magnets.

2. The switch according to claim 1, wherein arc deflector plates extend, in at least one of the switching chambers, in two opposite directions from the first contact region and the second contact region to the first and second arc chutes located at the terminations of the arc deflector plates.

3. The switch according to claim 1, wherein the contact parts of adjacent switching chambers are grouped with a common contact bridge to ensure their coupled movement.

4. The switch according to claim 3, wherein the contact bridge is designed in a manner that the contact parts of the adjacent switching chambers are electrically isolated from each other.

5. The switch according to claim 4, wherein the contact bridge includes a mounting component made of electrically insulating material and the contact parts of the adjacent switching chambers are mounted on this mounting component.

6. The switch according to claim 5, wherein the contact bridge comprising the contact parts of the adjacent switching chambers and a mounting component form a single mechanical unit.

7. The switch according to claim 1, wherein a contact part of the switching chambers is connected with a movable stranded wire to the connection clamp.

8. The switch according to claim 1, wherein the magnets extend at least one of along the are deflector plates or over the first and second arc chutes.

9. The switch according to claim 1, wherein the magnets include at least two plate-shaped magnets, a surface area of the magnets being aligned in parallel to each other.

10. The switch according to one claim 1, wherein at least two of the at least two switching chambers are aligned in a single plane.

11. The switch according to claim 10, wherein the contact parts, arc deflector plates and the first and second arc chutes of adjacent switching chambers are aligned in a single plane.

12. The switch according to claim 10, wherein the magnets are installed laterally outside the switching chambers and are aligned in a manner configured to generate a substantially homogeneous magnetic field at least in an area of the first and the second contact region of all switching chambers aligned in the same field.

13. The switch according to claim 1, wherein at least two of the at least two switching chambers are aligned on top of each other.

14. The switch according to claim 13, wherein the axes of movement of all contact parts coincide.

15. The switch according to claim 13, wherein the magnets are installed laterally outside the switching chambers and are aligned in a manner to generate a substantially homogeneous magnetic field at least in the area of the first and the second contact region of all switching chambers aligned on top of each other.

* * * * *